US012710205B2

(12) United States Patent
Lee et al.

(10) Patent No.: US 12,710,205 B2
(45) Date of Patent: Aug. 18, 2026

(54) DUAL CHILLER SYSTEM

(71) Applicant: SAMSUNG ELECTRONICS CO., LTD., Suwon-si (KR)

(72) Inventors: Gibong Lee, Suwon-si (KR); Hackwon Hwang, Suwon-si (KR); Kukil Lee, Suwon-si (KR); Daesung Kim, Suwon-si (KR); Jaewon Yoo, Suwon-si (KR); Jinyeob Jang, Suwon-si (KR); Teacksoo Jung, Suwon-si (KR)

(73) Assignees: SAMSUNG ELECTRONICS CO., LTD., Suwon-si (KR); Yest Co., Ltd., Pyeongtaek-si (KR)

( * ) Notice: Subject to any disclaimer, the term of this patent is extended or adjusted under 35 U.S.C. 154(b) by 193 days.

(21) Appl. No.: 18/615,635

(22) Filed: Mar. 25, 2024

(65) Prior Publication Data

US 2024/0377113 A1 Nov. 14, 2024

(30) Foreign Application Priority Data

Mar. 24, 2023 (KR) ..... 10-2023-0039197
May 12, 2023 (KR) ..... 10-2023-0061737

(51) Int. Cl.
*F25B 41/20* (2021.01)
*F25B 7/00* (2006.01)

(52) U.S. Cl.
CPC ..... *F25B 41/20* (2021.01); *F25B 7/00* (2013.01)

(58) Field of Classification Search
CPC ..... F25B 49/02; F25B 25/005; F25B 41/20; F25B 7/00; B01L 21/67109; B01L 21/67103; B01L 21/67271; G01R 31/22877; H01J 38/32091; H01J 37/32724
See application file for complete search history.

(56) References Cited

U.S. PATENT DOCUMENTS

| | | | | |
|---|---|---|---|---|
| 6,684,652 | B2 | 2/2004 | Kim et al. | |
| 9,885,747 | B2 | 2/2018 | Araike et al. | |
| 2017/0019078 | A1 | 1/2017 | Galal | |
| 2018/0062583 | A1 | 3/2018 | Zhao et al. | |
| 2019/0348306 | A1 * | 11/2019 | Koltonski | H01L 21/3065 |
| 2020/0366252 | A1 | 11/2020 | Britz et al. | |

(Continued)

FOREIGN PATENT DOCUMENTS

| | | | | |
|---|---|---|---|---|
| JP | H11231946 A | * | 8/1999 | |
| JP | 2002168551 A | * | 6/2002 | H01J 37/32009 |
| JP | 2004-014617 A | | 1/2004 | |

(Continued)

*Primary Examiner* — Kun Kai Ma
(74) *Attorney, Agent, or Firm* — Sughrue Mion, PLLC

(57) ABSTRACT

A dual chiller system includes a high-temperature tank configured to supply a first coolant of a first temperature to the outside, a low-temperature tank configured to supply a second coolant of a second temperature lower than the first temperature to the outside, a first automatic inlet valve and a second automatic inlet valve respectively connected to the high-temperature tank and the low-temperature, a first substrate processing device configured to receive the first coolant or the second coolant from the first automatic inlet valve and a second substrate processing device configured to receive the first coolant or the second coolant from the second automatic inlet valve, a cooling unit and a system controller.

20 Claims, 6 Drawing Sheets

(56) References Cited

U.S. PATENT DOCUMENTS

2022/0329155 A1 10/2022 Zhao et al.

FOREIGN PATENT DOCUMENTS

| | | | | | |
|---|---|---|---|---|---|
| JP | 2006080194 | A | * | 3/2006 | |
| JP | 2008-311492 | A | | 12/2008 | |
| JP | 4593007 | B2 | | 12/2010 | |
| JP | 2015-103712 | A | | 6/2015 | |
| KR | 10-0397047 | B1 | | 9/2003 | |
| KR | 20070050571 | A | * | 5/2007 | ..... C23C 16/50 |
| KR | 100746231 | B1 | * | 8/2007 | ..... H01L 23/38 |
| KR | 10-0889907 | B1 | | 3/2009 | |
| KR | 10-0890961 | B1 | | 3/2009 | |
| KR | 10-1438182 | B1 | | 9/2014 | |
| KR | 10-2016-0005886 | A | | 1/2016 | |
| KR | 20210106723 | A | * | 8/2021 | ..... H01L 21/67248 |
| KR | 10-2307839 | B1 | | 10/2021 | |
| KR | 102436005 | B1 | * | 8/2022 | ..... F25B 39/04 |
| KR | 102510849 | B1 | * | 3/2023 | ..... F25B 25/005 |
| TW | 200912989 | A | * | 3/2009 | ..... H01J 37/32165 |
| WO | 2014/157123 | A1 | | 10/2014 | |

* cited by examiner

DUAL CHILLER SYSTEM

CROSS-REFERENCE TO RELATED APPLICATIONS

This application is based on and claims priority under 35 U.S.C. § 119 to Korean Patent Application No. 10-2023-0039197 filed on Mar. 24, 2023, and Korean Patent Application No. 10-2023-0061737 filed on May 12, 2023, in the Korean Intellectual Property Office, the disclosures of which are incorporated by reference herein in their entireties.

BACKGROUND

1. Field

The disclosure relates to a dual chiller system, and more particularly, to a dual chiller system capable of selectively supplying a low-temperature coolant and a high-temperature coolant.

2. Description of Related Art

A high-temperature coolant and a low-temperature coolant may be supplied to a substrate processing device through a chiller system. In order to maintain the temperature of a coolant, continuous power consumption is made by a compressor.

SUMMARY

The disclosure relates to a dual chiller system with improved economy, performance, and reliability.

The disclosure is not limited to addressing the above-mentioned problems, and other applications not mentioned will be clearly understood by those skilled in the art from the following description.

According to an aspect of the disclosure, a dual chiller system includes: a high-temperature tank including a first heater and a first heat exchanger, the high-temperature tank configured to supply a first coolant of a first temperature; a low-temperature tank including a second heater and a second heat exchanger, the low-temperature tank configured to supply a second coolant of a second temperature lower than the first temperature; a first automatic inlet valve and a second automatic inlet valve respectively connected to the high-temperature tank and the low-temperature tank and configured to select and supply the first coolant supplied from the high-temperature tank or the second coolant supplied from the low-temperature tank; a first substrate processing device configured to receive the first coolant or the second coolant from the first automatic inlet valve and a second substrate processing device configured to receive the first coolant or the second coolant from the second automatic inlet valve; a cooling unit including a cascade, a compressor, a condenser, a first branch line configured to introduce a refrigerant from the compressor into a line supplying the refrigerant from the cascade to the low-temperature tank, a control valve provided on the first branch line, and the refrigerant circulating through the cascade, the compressor, and the condenser; and a system controller configured to: control an output level of the compressor, and control the first automatic inlet valve and the second automatic inlet valve to selectively supply the first coolant or the second coolant to the first substrate processing device and the second substrate processing device, wherein the output level of the compressor includes a first output level, a second output level, and a third output level, and wherein the first output level is greater than the second output level, and the second output level is greater than the third output level.

The system controller may be further configured to: control the first automatic inlet valve and the second automatic inlet valve to supply the first coolant to the first substrate processing device and the second substrate processing device when the output level is the third output level, control the first automatic inlet valve and the second automatic inlet valve to supply the first coolant to the first substrate processing device and to supply the second coolant to the second substrate processing device when the output level is the second output level, and control the first automatic inlet valve and the second automatic inlet valve to supply the second coolant to the first substrate processing device and the second substrate processing device when the output level is the first output level.

The high-temperature tank may further include a first circulation line and a first circulation pump provided on the first circulation line, the low-temperature tank may further include a second circulation line and a second circulation pump provided on the second circulation line, the first circulation line may be connected to the first heat exchanger and the second circulation line may be connected to the second heat exchanger, and the first circulation pump may be configured to circulate the first coolant through the first circulation line so that heat is exchanged in the first heat exchanger, and the second circulation pump may be configured to circulate the second coolant through the second circulation line so that heat is exchanged in the second heat exchanger.

The cooling unit may further include: a compressor circulation line connected to a line connecting the compressor and the condenser and also connected to a line connecting the cascade to the compressor; and a compressor circulation valve provided on the compressor circulation line, wherein the first branch line is configured to receive the refrigerant from the compressor circulation line.

The dual chiller system may further include a receiver in the cascade.

The dual chiller system may further include: a connection line configured to move the second coolant from the low-temperature tank to the high-temperature tank; and a control valve provided on the connection line.

The dual chiller system may further include a second branch line connecting the high-temperature tank to the second circulation line and configured to supply the first coolant to the second circulation line from the high-temperature tank.

Each of the first substrate processing device and the second substrate processing device may be configured to perform an electrical die sorting process.

The dual chiller system may further include: a first automatic outlet valve connected to the first substrate processing device by a first outlet line; and a second automatic outlet valve connected to the second substrate processing device by a second outlet line, wherein the first automatic outlet valve and the second automatic outlet valve are connected to the high-temperature tank and the low-temperature tank, respectively.

The system controller may be further configured to control the first automatic outlet valve and the second automatic outlet valve to supply either the first coolant or the second coolant to the first substrate processing device and the second substrate processing device, wherein, based on the first coolant being supplied to either the first substrate processing device or the second substrate processing device, the supplied first coolant is recovered to the high-temperature tank, and wherein, based on the second coolant being supplied to either the first substrate processing device or the second substrate processing device, the supplied second coolant is recovered to the low-temperature tank.

The first output level may be in a range from 80% to 100% of a maximum output of the compressor, the second output level may be in a range of 60% to 80% of the maximum output of the compressor, and the third output level may be less than 60% of the maximum output of the compressor.

The output level of the compressor may further include a fourth output level that is less than the first output level and the second output level, and the system controller may be further configured to: control the first automatic inlet valve and the second automatic inlet valve not to supply the first coolant and the second coolant to the first substrate processing device and the second substrate processing device when the output level is the fourth output level.

The first temperature may be 20° C. or more and 80° C. or less, and the second temperature may be −80° C. or more and −50° C. or less.

According to an aspect of the disclosure, a dual chiller system includes: a high-temperature tank including a first heater and a first heat exchanger, the high-temperature tank configured to supply a first coolant of a first temperature; a low-temperature tank including a second heater and a second heat exchanger, the low-temperature tank configured to supply a second coolant of a second temperature lower than the first temperature; a plurality of automatic inlet valves respectively connected to the high-temperature tank and the low-temperature tank and configured to select and supply the first coolant supplied from the high-temperature tank or the second coolant supplied from the low-temperature tank; a plurality of substrate processing devices configured to receive the first coolant or the second coolant from the plurality of automatic inlet valves, wherein a number of substrate processing devices included in the plurality of substrate processing devices is equal to a number of automatic inlet valves included in the plurality of automatic inlet valves; a cooling unit including a cascade, a compressor, a condenser, a first branch line configured to introduce a refrigerant from the compressor into a line supplying the refrigerant from the cascade to the low-temperature tank, and a control valve provided on the first branch line; and a system controller configured to: control an output level of the compressor, and control the plurality of automatic inlet valves to selectively supply the first coolant or the second coolant to each of the plurality of substrate processing devices, wherein the output level of the compressor includes a plurality of output levels, wherein a number of output levels included in the plurality of output levels is one greater than the number of substrate processing devices included in the plurality of substrate processing devices, and wherein M is a natural number less than the number of substrate processing devices included in the plurality of substrate processing devices, and an Mth output level is greater than an (M+1)th output.

The system controller may be further configured to: control the plurality of automatic inlet valves to supply the first coolant to P substrate processing devices among the plurality of substrate processing devices when the output level of the compressor is a (P+1)th output, wherein P is either 0 or a natural number equal to or less than the number of substrate processing devices included in the plurality of substrate processing devices.

The plurality of substrate processing devices may include of three substrate processing devices, and the plurality of automatic inlet valves consists of three automatic inlet valves.

The high-temperature tank may further include a first circulation line and a first circulation pump provided on the first circulation line, the low-temperature tank may further include a second circulation line and a second circulation pump provided on the second circulation line, the first circulation line may be connected to the first heat exchanger and the second circulation line may be connected to the second heat exchanger, the first circulation pump may be configured to circulate the first coolant through the first circulation line so that heat is exchanged in the first heat exchanger, and the second circulation pump may be configured to circulate the second coolant through the second circulation line so that heat is exchanged in the second heat exchanger.

The dual chiller system may further include: a connection line configured to move the second coolant from the low-temperature tank to the high-temperature tank; a control valve provided on the connection line; and a second branch line connecting the high-temperature tank to the second circulation line and configured to supply the first coolant to the second circulation line from the high-temperature tank.

According to an aspect of the disclosure, a dual chiller system includes: a high-temperature tank including a first heater, a first heat exchanger, a first circulation line, and a first circulation pump provided on the first circulation line, wherein the high-temperature tank is configured to supply a first coolant of a first temperature; a low-temperature tank including a second heater, a second heat exchanger, a second circulation line, and a second circulation pump provided on the second circulation line, wherein the low-temperature tank is configured to supply a second coolant of a second temperature lower than the first temperature; a first automatic inlet valve and a second automatic inlet valve respectively connected to the high-temperature tank and the low-temperature tank and configured to select and supply the first coolant supplied from the high-temperature tank or the second coolant supplied from the low-temperature tank; a first substrate processing device configured to receive the first coolant or the second coolant from the first automatic inlet valve and a second substrate processing device configured to receive the first coolant or the second coolant from the second automatic inlet valve; a first automatic outlet valve connected to the first substrate processing device by a first outlet line; a second automatic outlet valve connected to the second substrate processing device by a second outlet line; a cooling unit including a cascade, a compressor, a condenser, a first branch line configured to introduce a refrigerant from the compressor into a line supplying the refrigerant from the cascade to the low-temperature tank, a control valve provided on the first branch line, and the refrigerant circulating through the cascade, the compressor, and the condenser, wherein the cascade includes a receiver; and a system controller, wherein the first circulation line is connected to the first heat exchanger and the second circulation line is connected to the second heat exchanger, wherein an output level of the compressor includes a first output level, a second output level, and a third output level, wherein the first output level is greater than the second output level, and the second output level is greater than the third output level, and wherein the system controller is configured to: control the output level to be the third output level and control the first automatic inlet valve and the second automatic inlet valve to supply the first coolant to the first substrate processing device and the second substrate processing device when the output level is the third output level, control the output level to be the second output level and control the first automatic inlet valve and the second automatic inlet valve to supply the first coolant to the first substrate processing device and to supply the second coolant to the second substrate processing device when the output level is the second output level, and control the output level to be the first output level and control the first automatic inlet valve and the second automatic inlet valve to supply the second coolant to the first substrate processing device and the second substrate processing device when the output level is the first output level.

The dual chiller system may further include: a connection line configured to move the second coolant from the low-temperature tank to the high-temperature tank; a control valve provided on the connection line; and a second branch line connecting the high-temperature tank to the second circulation line and configured to supply the first coolant to the second circulation line from the high-temperature tank, wherein the cooling unit may further include: a compressor circulation line connected to a line connecting the compressor and the condenser and also connected to a line connecting the cascade to the compressor; and a compressor circulation valve provided on the compressor circulation line, wherein each of the first substrate processing device and the second substrate processing device may be configured to perform an electrical die sorting process, wherein the output level of the compressor may further include a fourth output level that is less than the first output level and the second output level, wherein the first output level may be in a range of 80% to 100% of a maximum output of the compressor, the second output level may be in a range of 60% to 80% of the maximum output of the compressor, and the third output level may be less than 60% of the maximum output of the compressor, wherein the system controller may be further configured to: control the output level to be the fourth output level and control the first automatic inlet valve and the second automatic inlet valve not to supply the first coolant and the second coolant to the first substrate processing device and the second substrate processing device when the output level is the fourth output level, and wherein the first temperature may be 20° C. or more and 80° C. or less, and the second temperature may be −80° C. or more and −50° C. or less.

According to an aspect of the disclosure, a dual chiller system includes: a first tank including a first heater and a first heat exchanger, the first tank configured to supply a first coolant of a first temperature; a second tank including a second heater and a second heat exchanger, the second tank configured to supply a second coolant of a second temperature lower than the first temperature; a plurality of automatic inlet valves each connected to the first tank and the second tank and configured to select and supply the first coolant supplied from the first tank or the second coolant supplied from the second tank; a plurality of substrate processing devices configured to receive the first coolant or the second coolant from the plurality of automatic inlet valves; a cooling unit including: a cascade, a compressor, a condenser, a first branch line configured to introduce a refrigerant from the compressor into a line supplying the refrigerant from the cascade to the second tank, a control valve provided on the first branch line, and the refrigerant circulating through the cascade, the compressor, and the condenser; and a system controller configured to: control an output level of the compressor, and control the plurality of automatic inlet valves to selectively supply the first coolant or the second coolant to each of the plurality of substrate processing devices, wherein the cascade, the compressor, the condenser and the second tank are in fluid communication with one another, and wherein the compressor is configured to operate at a plurality of output levels.

BRIEF DESCRIPTION OF THE DRAWINGS

The above and other aspects, features, and advantages of certain embodiments will be more clearly understood from the following detailed description taken in conjunction with the accompanying drawings, in which.

DETAILED DESCRIPTION

Figure 1:
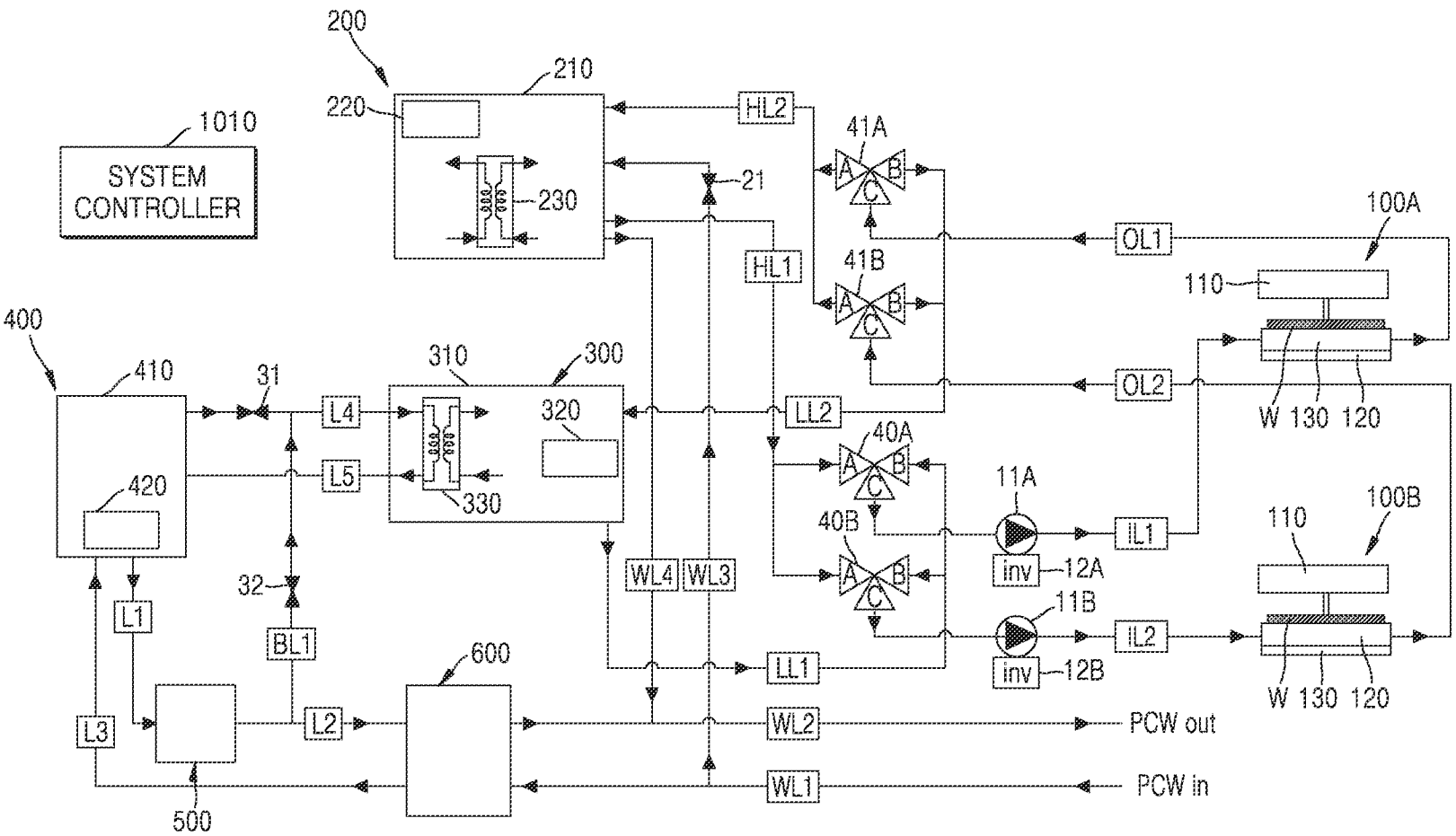
FIG. 1 is a diagram illustrating a dual chiller system according to an embodiment.

Hereinafter, embodiments of the disclosure will be described in detail with reference to the accompanying drawings. Like reference numerals refer to like elements, and their repetitive descriptions are omitted.

Figure 2:
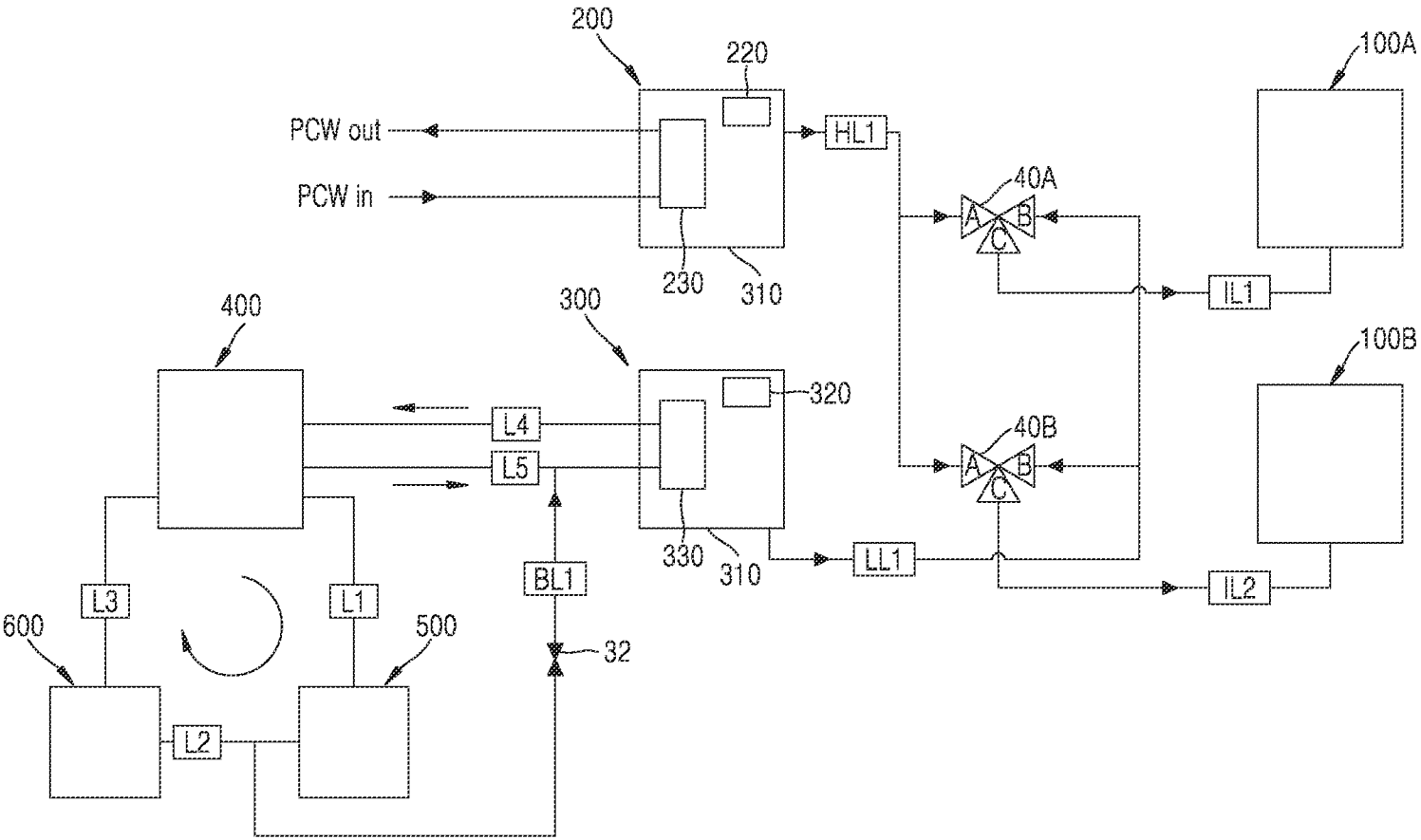
FIG. 2 is a diagram illustrating a configuration of a dual chiller system according to an embodiment.
Figure 3:
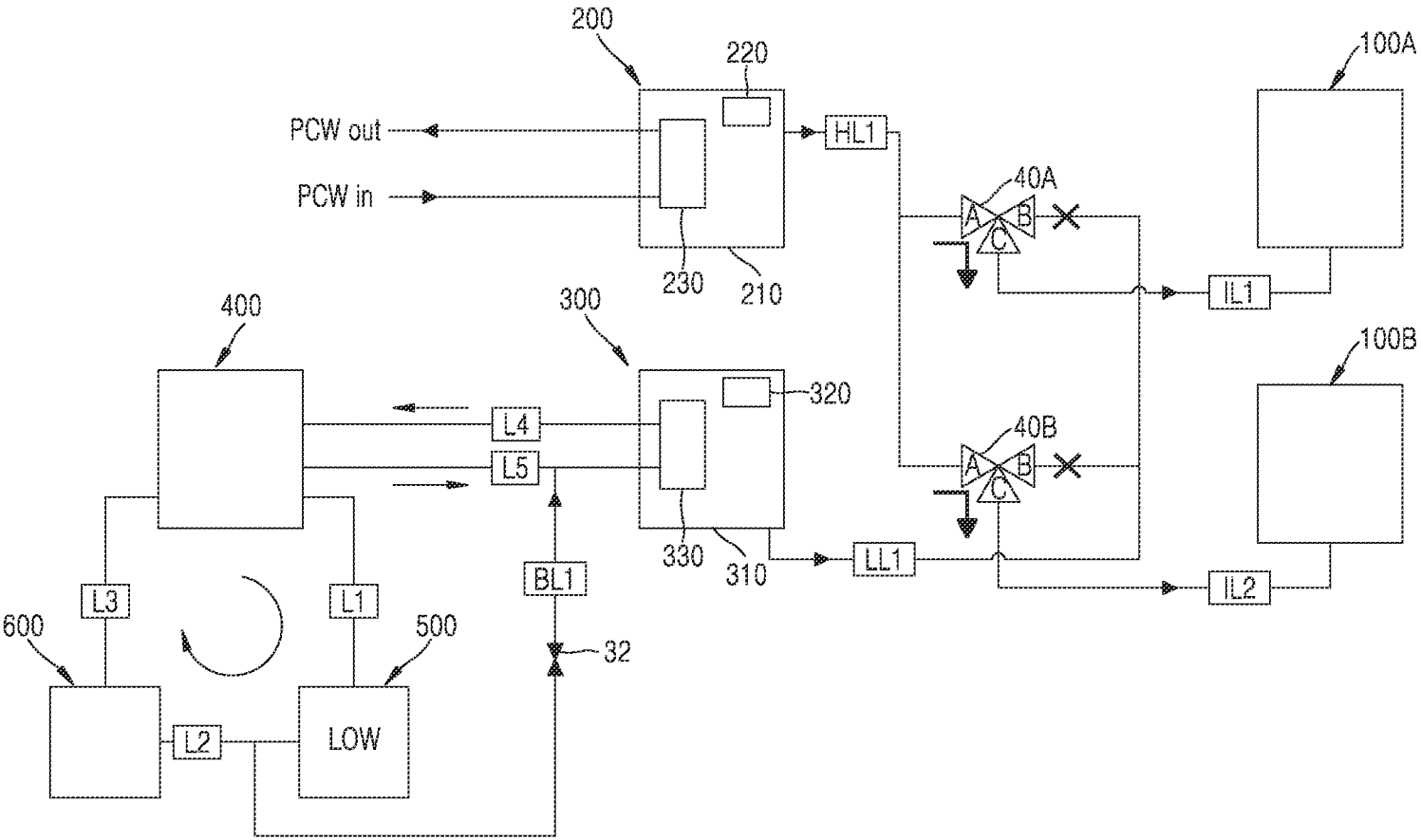
FIG. 3 is a diagram illustrating an operation of a dual chiller system according to an embodiment.
Figure 4:
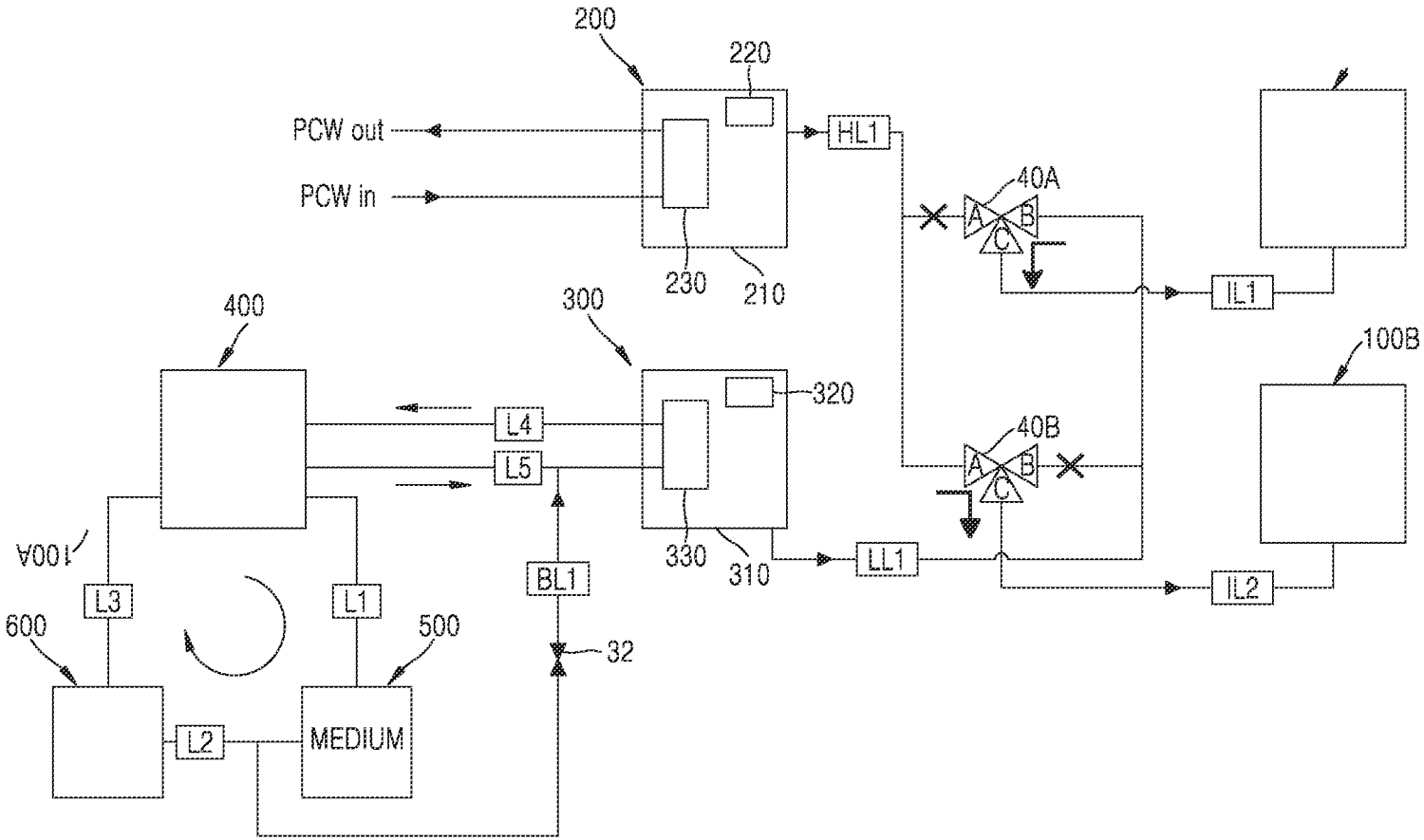
FIG. 4 is a diagram illustrating an operation of a dual chiller system according to an embodiment.
Figure 5:
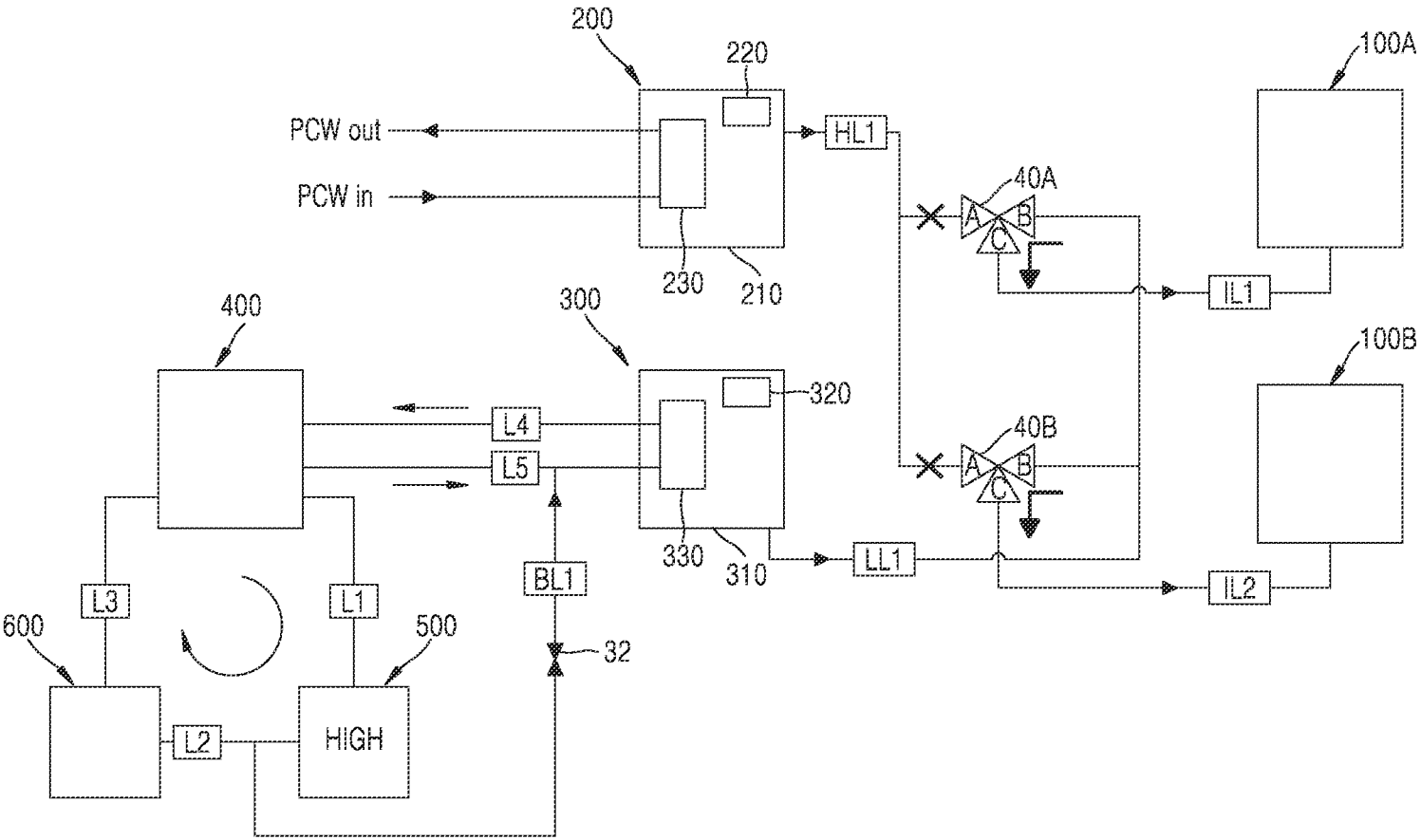
FIG. 5 is a diagram illustrating an operation of a dual chiller system according to an embodiment.

FIG. 1 is a diagram illustrating a dual chiller system 1000A according to an embodiment. FIG. 2 is a diagram illustrating a configuration of the dual chiller system 1000A according to an embodiment. FIG. 3 is a diagram illustrating an operation of the dual chiller system 1000A according to an embodiment. FIG. 4 is a diagram illustrating an operation of the dual chiller system 1000A according to an embodiment. FIG. 5 is a diagram illustrating an operation of the dual chiller system 1000A according to an embodiment.

Referring to FIG. 1, the dual chiller system 1000A according to an embodiment may include a substrate processing unit, a high-temperature unit, a low-temperature unit, and an automatic valve unit. The high-temperature unit may include a high-temperature tank 200. The low-temperature unit may include a low-temperature tank 300 and a cooling unit including a cascade 400, a compressor 500, and a condenser 600. The automatic valve unit may include a first automatic inlet valve 40A, a second automatic inlet valve 40B, a first automatic outlet valve 41A, and a second automatic outlet valve 41B.

Generally speaking, the high-temperature unit may supply a coolant at a higher temperature than the low-temperature unit, that is, a high-temperature coolant, to the substrate processing unit through heat exchange with process cooling water (PCW) supplied from the outside. The cooling unit may supply a low-temperature refrigerant to the low-temperature tank 300 through the PCW supplied from the outside to supply a low-temperature coolant to the automatic valve unit. The automatic valve unit may selectively supply the received high-temperature coolant and low-temperature coolant to the substrate processing unit. In the current specification, the high-temperature coolant may be referred to as a first coolant and the low-temperature coolant may be referred to as a second coolant.

The PCW may be supplied from a separate PCW device to the dual chiller system 1000A, and the used PCW may be discharged from the dual chiller system 1000A to the PCW device. The PCW may be supplied to the high-temperature tank 200 of the high-temperature unit and the condenser 600 of the low-temperature unit.

The PCW may be supplied from the PCW device to the condenser 600 of the cooling unit through a first PCW line WL1. After heat exchange is performed by the condenser 600, the PCW may be discharged to the PCW device through a second PCW line WL2.

The PCW may be introduced into and discharged from the high-temperature tank 200. For example, a third PCW line WL3 branched from the first PCW line WL1 may supply the PCW to the high-temperature tank 200. The PCW heat-exchanged by a first heat exchanger 230 in the high-temperature tank 200 may be discharged from the high-temperature tank 200 through a fourth PCW line WL4. The PCW may be discharged from the high-temperature tank 200 through the second PCW line WL2 connected to the fourth PCW line WL4. A PCW valve 21 may be provided on the third PCW line WL3. The PCW valve 21 may control the temperature of the high-temperature coolant supplied from the high-temperature tank 200 by controlling the flow rate of the PCW supplied to the high-temperature tank 200.

The high-temperature unit may include the high-temperature tank 200. The high-temperature tank 200 may include a high-temperature tank body 210, a first heater 220, and the first heat exchanger 230. The PCW may be introduced into and discharged from the high-temperature tank body 210 through the third PCW line WL3 and the fourth PCW line WL4, respectively. In addition, the high-temperature coolant may be supplied from the high-temperature tank 200 to the automatic valve unit through a first high-temperature coolant line HL1, and the high-temperature coolant passing through the substrate processing unit may return to the high-temperature tank 200 through a second high-temperature coolant line HL2. The high-temperature tank 200 may also be referred to as a normal-temperature tank.

The PCW introduced into the high-temperature tank body 210 may exchange heat with the high-temperature coolant in the high-temperature tank 200 in the first heat exchanger 230. The temperature of the high-temperature coolant may be higher than the temperature of the PCW supplied through the third PCW line WL3. The high-temperature coolant in the high-temperature tank 200, which continuously exchanges heat with the introduced PCW, may maintain a specific temperature. The specific temperature of the high-temperature coolant maintained in the high-temperature tank 200 may be referred to as a first temperature.

The first temperature of the high-temperature coolant in the high-temperature tank 200 may vary depending on the temperature and flow rate of the PCW, the flow rate and temperature of the high-temperature coolant introduced into the first heat exchanger 230, and the degree of heat exchange in the first heat exchanger 230. Because the temperature of a coolant to be supplied to the substrate processing unit needs to be maintained uniformly, the first heater 220 may additionally supply heat to maintain the first temperature of the high-temperature coolant. The high-temperature tank 200 may include a thermometer. The first heater 220 may control and maintain the temperature of the high-temperature coolant stored in the high-temperature tank 200 through a system controller 1010. However, it is preferable to minimize power used by the first heater 220 by controlling the flow rate of inflow and outflow of the first heat exchanger 230. For example, the first temperature may be 0° C. or more and 40° C. or less, 5° C. or more and 30° C. or less, or 20° C. or more and 80° C. or less. Alternatively, the first temperature may be in a general normal-temperature range. The range of the first temperature is not limited thereto, and may be set as necessary in a range in which the dual chiller system 1000A according to an embodiment may operate.

The low-temperature unit may include the low-temperature tank 300 and the cooling unit. The low-temperature tank 300 may include a low-temperature tank body 310, a second heater 320, and a second heat exchanger 330. The cooling unit may include the cascade 400, the compressor 500, and the condenser 600.

The cascade 400 may include a cascade body 410 and a receiver 420. The cascade 400 may supply a refrigerant to the compressor 500 through a first line L1. The compressor 500 may include a compressor inverter. The compressor inverter may control an output level of the compressor 500 under the control of the system controller 1010. In the current disclosure, the output level of the compressor 500 is described by Hz representing the number of rotations of the compressor, but those skilled in the art will understand that this notation may be expressed in other ways as a way of expressing the output level.

As an embodiment, in the dual chiller system 1000A according to an embodiment, when the output level of the compressor 500 is up to 60 Hz, the output level of the compressor 500 is controlled according to an output required by the dual chiller system 1000A and may be controlled to 60 Hz or less by the compressor inverter. Details of controlling the output level of the compressor 500 is described below.

The refrigerant in a high-temperature and high-pressure state through the compressor 500 is introduced into the condenser 600 through a second line L2 connecting the compressor 500 to the condenser 600. In the second line L2, the refrigerant in the high-temperature and high-pressure state may be mixed into a fourth line LA through a first branch line BL1 supplied to the fourth line LA, as described below. A detailed description of the refrigerant mixed into the fourth line LA through the first branch line BL1 is described below.

The refrigerant introduced into the condenser 600 through the second line L2 may be cooled and condensed through heat exchange through the PCW supplied from the outside through the first PCW line WL1. The refrigerant cooled and condensed by the condenser 600 may be moved to the cascade 400 through a third line L3 connecting the condenser 600 to the cascade 400.

The cascade 400 may supply the refrigerant supplied through the third line L3 to the low-temperature tank 300 through stepless or one or more stages of heat exchange. While the refrigerant passes through the cascade 400, the refrigerant that has been liquefied before passing through an expansion valve 31 may be partially vaporized. That is, liquid and gaseous refrigerants may coexist in the cascade 400. Compression is performed by supplying the gaseous refrigerant to the compressor 500 through the first line L1. When the liquid refrigerant is supplied to the compressor 500, the lifespan of the compressor 500 may be reduced. The receiver 420 may classify the gaseous refrigerant from the liquid refrigerant. Therefore, the liquid refrigerant may be supplied to the second heat exchanger 330 in the low-temperature tank 300 through the receiver 420, and the cooling unit may obtain stable cooling capability. The refrigerant evaporated into a gas by the second heat exchanger 330 may be completely converted into a gas again through the cascade 400 and then introduced into the compressor 500. In the dual chiller system 1000A according to an embodiment, the receiver 420 may be provided in the cascade body 410.

The refrigerant may be supplied to the low-temperature tank 300 through the fourth line LA connecting the cascade 400 to the low-temperature tank 300. The expansion valve 31 may be provided on the fourth line LA. The expansion valve 31 may reduce the temperature of the refrigerant by throttling and expanding the liquefied refrigerant. The low-temperature refrigerant in a gaseous state, which is throttled and expanded through the expansion valve 31, may be supplied to the second heat exchanger 330 of the low-temperature tank 300.

However, before the vaporized refrigerant reaches the second heat exchanger 330, the high-temperature and high-pressure refrigerant supplied from the first branch line BL1 may be introduced and mixed. In the dual chiller system 1000A according to an embodiment, the temperatures of the high-temperature coolant and the low-temperature coolant stored in the high-temperature tank 200 and the low-temperature tank 300 need to be maintained constant. The low-temperature coolant in the low-temperature tank 300 is maintained at a second temperature by heat exchange with the low-temperature refrigerant through the second heat exchanger 330. However, the temperature of the low-temperature refrigerant supplied to the low-temperature tank 300 may vary due to various reasons such as heat loss in the device, fluctuations in an ambient temperature, and changes in state of the device.

In general, the temperature of the low-temperature refrigerant introduced into and discharged from the second heat exchanger 330 must be lower than the final temperature of the low-temperature coolant cooled through the second heat exchanger 330 to facilitate heat exchange between the refrigerant and the low-temperature coolant. When the temperature of the low-temperature refrigerant introduced into the second heat exchanger 330 changes, the temperature of the low-temperature coolant exchanging heat with the low-temperature refrigerant may be lower than the second temperature that is the target temperature. Therefore, the temperature of the low-temperature coolant in the low-temperature tank 300 is controlled to the second temperature by increasing the temperature of the low-temperature coolant through the second heater 320 included in the low-temperature tank 300. However, considering power consumption, it is not desirable to heat the low-temperature coolant only by the second heater 320 in order to maintain the second temperature that is the target temperature and thus to additionally consume power although the cooling unit already consumed power in order to lower the temperature of the low-temperature coolant. For example, the second temperature may be −100° C. or more and −50° C. or less or −90° C. or more and −60° C. or less. Alternatively, the second temperature may be about −65° C.

In order to reduce energy consumption in the second heater 320, a gaseous high-temperature refrigerant may be mixed through the first branch line BL1 to increase the temperature of the low-temperature refrigerant supplied through the fourth line LA.

A control valve 32 may be provided on the first branch line BL1 to control the amount of the high-temperature refrigerant supplied to the fourth line LA of the high-temperature refrigerant. The amount of the refrigerant supplied through the first branch line BL1 may be controlled through the control valve 32 so that the low-temperature refrigerant is introduced into the second heat exchanger 330 at a temperature lower than the second temperature. For example, when the temperature difference between the second temperature and the low-temperature refrigerant expanded through the expansion valve 31 is large, the temperature difference between the second temperature and the refrigerant introduced into the second heat exchanger 330 may be reduced by supplying the high-temperature refrigerant through the control valve 32. Accordingly, power used for temperature control of the second heater 320 provided in the low-temperature tank 300 may be reduced.

On the other hand, for example, the temperature difference between the second temperature and the low-temperature refrigerant expanded through the expansion valve 31 may be small. When the temperature difference between the second temperature and the low-temperature refrigerant expanded through the expansion valve 31 is small as described above, a supply amount of the high-temperature refrigerant may be reduced through the control valve 32.

The refrigerant passing through the second heat exchanger 330 through the fourth line LA may be introduced into the cascade 400 through a fifth line L5 connecting the second heat exchanger 330 to the cascade 400.

The high-temperature coolant maintained at the first temperature in the high-temperature tank 200 and the low-temperature coolant maintained at the second temperature in the low-temperature tank 300 may be introduced into the automatic valve unit. The automatic valve unit may include the first automatic inlet valve 40A, the second automatic inlet valve 40B, the first automatic outlet valve 41A, and the second automatic outlet valve 41B. Each of the automatic valves constituting the automatic valve unit may include a three-way automatic valve. The three-way automatic valve may allow fluid to be introduced into and discharged from a three-part valve and may select fluid flow.

Fluid may be introduced into a valve A and a valve B of the three-way automatic valve and may be discharged to a valve C of the three-way automatic valve. Alternatively, fluid may be discharged to the valve A and the valve B of the three-way automatic valve and may be introduced into the valve C of the three-way automatic valve. The first automatic inlet valve 40A and the second automatic inlet valve 40B may select the fluid introduced into the valve A or the valve B and may discharge the fluid to the valve C. The first automatic outlet valve 41A and the second automatic outlet valve 41B may have the fluid discharged to the valve A and the valve B and may have the fluid introduced into the valve C.

Each of the first automatic inlet valve 40A, the second automatic inlet valve 40B, the first automatic outlet valve 41A, and the second automatic outlet valve 41B of the automatic valve unit may be provided with a converter to control fluid selection and fluid flow through the system controller 1010.

The dual chiller system 1000A according to an embodiment is described with reference to FIGS. 1 and 2 to 5. FIGS. 2 to 5 are diagrams simplified by omitting some components of the dual chiller system 1000A according to an embodiment for description.

Referring to FIGS. 1 and 2, the high-temperature coolant may flow from the high-temperature tank 200 through the first high-temperature coolant line HL1 connected to the first automatic inlet valve 40A and the second automatic inlet valve 40B. The low-temperature coolant may flow from the low-temperature tank 300 through a first low-temperature coolant line LL1 connected to the first automatic inlet valve 40A and the second automatic inlet valve 40B.

The first high-temperature coolant line HL1 may be connected to the valve A of the first automatic inlet valve 40A and the valve A of the second automatic inlet valve 40B to supply the high-temperature coolant to the valve A of the first automatic inlet valve 40A and the valve A of the second automatic inlet valve 40B.

The first low-temperature coolant line LL1 may be connected to the valve B of the first automatic inlet valve 40A and the valve B of the second automatic inlet valve 40B to supply the low-temperature coolant to the valve B of the first automatic inlet valve 40A and the valve B of the second automatic inlet valve 40B.

A coolant selected by the system controller 1010 in the first automatic inlet valve 40A and the second automatic inlet valve 40B and introduced into the substrate processing unit may be referred to as an inlet coolant. The inlet coolant passing through the first automatic inlet valve 40A and the second automatic inlet valve 40B may flow to each substrate processing device through a first pump 11A and a second pump 11B.

Through a first inlet line IL1 connected to the first automatic inlet valve 40A and a first substrate processing device 100A, the inlet coolant may be supplied from the first automatic inlet valve 40A to the first substrate processing device 100A. The first pump 11A and a first pump inverter 12A controlling the first pump 11A may be provided on the first inlet line IL1. The first pump 11A and the first pump inverter 12A may control the flow rate of the inlet coolant supplied to the first substrate processing device 100A. The first pump inverter 12A may be controlled by the system controller 1010.

Through a second inlet line IL2 connected to the second automatic inlet valve 40B and a second substrate processing device 100B, the inlet coolant may be supplied from the second automatic inlet valve 40B to the second substrate processing device 100B. The second pump 11B and a second pump inverter 12B controlling the second pump 11B may be provided on the second inlet line IL2. The second pump 11B and the second pump inverter 12B may control the flow rate of the inlet coolant supplied to the second substrate processing device 100B. The second pump inverter 12B may be controlled by the system controller 1010.

The first substrate processing device 100A and the second substrate processing device 100B requiring two different temperatures of coolants may be applied to the dual chiller system 1000A. Each of the first substrate processing device 100A and the second substrate processing device 100B in the dual chiller system 1000A according to an embodiment may include an electrical die sorting (EDS) device.

In an EDS process performed through the EDS device, an electrical signal is applied to semiconductor devices formed on a substrate W through a probe, a signal output from the semiconductor devices is read in response to the applied electrical signal, and then it is determined whether the semiconductor devices are defective based on the read signal.

The first substrate processing device 100A may include a probe station 110, a heating unit 120 for direct temperature control, and a substrate support unit 130 positioned on the heating unit 120 and on which the substrate W is arranged. The second substrate processing device 100B may also have the same configuration.

According to one or more embodiments, in order to test electrical characteristics of a device to be tested, the EDS device may perform at least one of a direct current (DC) test and an alternating current (AC) test on the substrate W. Here, in the DC test, a predetermined potential is applied to an input pad of the substrate W and DC characteristics such as open/short, an input current, an output potential, and a power supply current are measured to determine whether the device to be tested is defective. In addition, in the AC test, a pulse signal is applied to the input pad of the substrate W and operating characteristics such as the input/output transport delay time and start/end time of an output signal are measured to determine whether the device to be tested is defective.

In the EDS process using the EDS device, because an electrical signal is applied to the substrate W through a probe, heat may be generated in the substrate W. Alternatively, in the EDS process, the substrate W may be tested under a specific temperature condition. The EDS device may achieve the specific temperature condition through the temperature of the supplied inlet coolant. That is, when the high-temperature coolant of the first temperature is supplied to the EDS device, the EDS process may be performed by the EDS device under conditions caused by the first temperature. Alternatively, when the low-temperature coolant of the second temperature is supplied to the EDS device, the EDS process may be performed by the EDS device under conditions caused by the second temperature. That is, coolants of different temperatures may be selectively supplied to the substrate processing device including the EDS device by the dual chiller system 1000A according to an embodiment.

The first substrate processing device 100A and the second substrate processing device 100B may require coolants of the same temperature or coolants of different temperatures. For example, the high-temperature coolant of the first temperature may be supplied to both the first substrate processing device 100A and the second substrate processing device 100B.

Referring to FIG. 3, the first automatic inlet valve 40A may discharge the high-temperature coolant of the first temperature introduced into the valve A to the valve C. On the other hand, the first automatic inlet valve 40A may block the low-temperature coolant of the second temperature introduced into the valve B. Accordingly, the high-temperature coolant may be supplied from the valve C of the first automatic inlet valve 40A to the first substrate processing device 100A through the first inlet line IL1. Similarly, the high-temperature coolant may be supplied from the valve C of the second automatic inlet valve 40B to the second substrate processing device 100B through the second inlet line IL2.

As illustrated in FIG. 3, when only the high-temperature coolant is supplied to the substrate processing device and the low-temperature coolant is not supplied to the substrate processing device, heat is not additionally supplied to the low-temperature coolant in the low-temperature tank 300. Accordingly, in order to reduce overall power consumption, the system controller 1010 may control the compressor inverter to control the output level of the compressor 500 of the cooling unit. As described above, assuming that the maximum output level of the compressor 500 is, for example, 60 Hz, when the low-temperature coolant is not supplied to the substrate processing device, the output level of the compressor 500 may be 20 Hz or more and 40 Hz or less. Alternatively, when the low-temperature coolant is not supplied to the substrate processing device, the output level of the compressor 500 may be 30 Hz or more and 40 Hz or less. That is, the dual chiller system 1000A may be operated by the relatively low output level of the compressor 500. In FIG. 3, the compressor 500 is marked with LOW, indicating that a low output level is required. A numerical range of the output level of the compressor 500 may be selected within a range for a stable operation of the dual chiller system 1000A according to an embodiment. Accordingly, the numerical range of the output level of the compressor 500 is not limited thereto.

Referring to FIG. 4, the first automatic inlet valve 40A may discharge the low-temperature coolant of the second temperature introduced into the valve B to the valve C. On the other hand, the first automatic inlet valve 40A may block the high-temperature coolant of the first temperature introduced into the valve A. Accordingly, the low-temperature coolant may be supplied from the valve C of the first automatic inlet valve 40A to the first substrate processing device 100A through the first inlet line IL1.

In contrast, the first automatic inlet valve 40A may discharge the high-temperature coolant of the first temperature introduced into the valve A to the valve C. On the other hand, the first automatic inlet valve 40A may block the low-temperature coolant of the second temperature introduced into the valve B. Accordingly, the high-temperature coolant may be supplied from the valve C of the second automatic inlet valve 40B to the second substrate processing device 100B through the second inlet line IL2.

As illustrated in FIG. 4, the high-temperature coolant and the low-temperature coolant may be supplied to each of the two substrate processing devices. That is, when the low-temperature coolant is supplied to one substrate processing device, the amount of heat additionally supplied to the low-temperature coolant in the low-temperature tank 300 is less than when the low-temperature coolant is supplied to the two substrate processing devices. However, when the low-temperature coolant is supplied to one substrate processing device, the amount of heat additionally supplied to the low-temperature coolant in the low-temperature tank 300 is greater than when the low-temperature coolant is not supplied to the substrate processing device. In order to control the overall power consumption, the system controller 1010 may control the compressor inverter to control the output level of the compressor 500 of the cooling unit.

For example, assuming that the maximum output level of the compressor 500 is, for example, 60 Hz, when the low-temperature coolant is supplied to one of the two substrate processing devices, the output level of the compressor 500 may be 30 Hz or more and 50 Hz or less. Alternatively, when the low-temperature coolant is supplied to one of the two substrate processing devices, the output level of the compressor 500 may be 40 Hz or more and 50 Hz or less. In FIG. 4, the compressor 500 is marked with MEDIUM, indicating that a medium output level is required. The numerical range of the output level of the compressor 500 may be selected within the range for the stable operation of the dual chiller system 1000A according to an embodiment. Accordingly, the numerical range of the output level of the compressor 500 is not limited thereto.

Referring to FIG. 5, the first automatic inlet valve 40A may discharge the low-temperature coolant of the second temperature introduced into the valve B to the valve C. On the other hand, the first automatic inlet valve 40A may block the high-temperature coolant of the first temperature introduced into the valve A. Accordingly, the low-temperature coolant may be supplied from the valve C of the first automatic inlet valve 40A to the first substrate processing device 100A through the first inlet line IL1. Similarly, the low-temperature coolant may be supplied from the valve C of the second automatic inlet valve 40B to the second substrate processing device 100B through the second inlet line IL2.

As illustrated in FIG. 5, the low-temperature coolant may be supplied to both of the two substrate processing devices. That is, when the low-temperature coolant is supplied to the two substrate processing devices, the amount of heat additionally supplied to the low-temperature coolant in the low-temperature tank 300 is greater than when the low-temperature coolant is supplied to the one substrate processing device. In order to control the overall power consumption, the system controller 1010 may control the compressor inverter to control the output level of the compressor 500 of the cooling unit.

For example, assuming that the maximum output level of the compressor 500 is, for example, 60 Hz, when the low-temperature coolant is supplied to both of the two substrate processing devices, the output level of the compressor 500 may be 50 Hz or more and 60 Hz or less. Alternatively, when the low-temperature coolant is supplied to both of the two substrate processing devices, the output level of the compressor 500 may be maintained as 60 Hz. In FIG. 5, the compressor 500 is marked with HIGH, indicating that a high output level is required. The numerical range of the output level of the compressor 500 may be selected within the range for the stable operation of the dual chiller system 1000A according to an embodiment.

In summary, in the dual chiller system 1000A according to an embodiment, the output level of the compressor 500 may be controlled according to the coolant supplied to the first substrate processing device 100A and the second substrate processing device 100B included in a substrate processing device unit. When the low-temperature coolant is supplied to both of the two substrate processing devices, the system controller 1010 may control the output level of the compressor 500 as a first output level. When the high-temperature coolant and the low-temperature coolant are supplied to each of the two substrate processing devices, the system controller 1010 may control the output level of the compressor 500 as a second output level. When the high-temperature coolant is supplied to both of the two substrate processing devices, the system controller 1010 may control the output level of the compressor 500 as a third output. Here, the first output level may be greater than the second output level and the second output level may be greater than the third output level.

In an embodiment, the first output level may be in a range of about 80% to about 100% based on the maximum output of the compressor 500. The second output level may be in a range of about 60% to about 80% based on the maximum output of the compressor 500. The third output level may be less than about 60% based on the maximum output of the compressor 500. The first to third output levels may be selected by the system controller 1010 within the above range. Alternatively, each of the first to third output levels may be a fixed output level value.

In contrast, ranges of the first output level and the second output level, or the second output level and the third output level may overlap in at least a partial region, which may occur when the flow rate of the coolant to be supplied to the first substrate processing device 100A and the second substrate processing device 100B included in the substrate processing device unit is small or large. For example, when the low-temperature coolant is supplied to both of the two substrate processing devices but the flow rate of the supplied low-temperature coolant is small, the high-temperature coolant and the low-temperature coolant are supplied to each of the two substrate processing devices. This is because the required output level of the compressor 500 may be lower than when the flow rate of each of the high-temperature coolant and the low-temperature coolant is large.

The range of the output level of the compressor 500 may be properly selected by a technician according to the operation of the dual chiller system 1000A according to an embodiment. Accordingly, the range of the output level of the compressor 500 is not limited thereto.

The dual chiller system 1000A according to an embodiment may selectively supply the coolant according to the temperature of the coolant required by each of the first substrate processing device 100A and the second substrate processing device 100B included in the substrate processing device unit. In addition, the required output level of the compressor 500 may be controlled according to the temperature of the supplied coolant. Accordingly, the output level of the compressor 500 may be matched to required cooling capacity, and the coolant may be selectively supplied to the substrate processing unit according to the temperature of the coolant. Accordingly, the dual chiller system 1000A according to an embodiment may effectively supply the coolant to the substrate processing device and may reduce power consumption to improve system operation efficiency.

In addition, the second heater 320 is used to correctly maintain the temperature of the low-temperature coolant in the low-temperature tank 300 at the second temperature. In the dual chiller system 1000A according to an embodiment, the high-temperature refrigerant passing through the compressor 500 is mixed into the low-temperature refrigerant passing through the expansion valve 31 through the first branch line BL1 to properly control the temperature of the low-temperature refrigerant introduced into the second heat exchanger 330 and thus to reduce power used by the second heater 320 of the low-temperature tank 300. The temperature of the low-temperature refrigerant introduced into the second heat exchanger 330 may be controlled by controlling the control valve 32 on the first branch line BL1. Due to this configuration, the dual chiller system 1000A according to an embodiment may effectively supply the coolant to the substrate processing device and may reduce power consumption to improve system operation efficiency.

A first outlet line OL1 may connect the first automatic outlet valve 41A to the first substrate processing device 100A. An inlet refrigerant passing through the first substrate processing device 100A may flow to the first automatic outlet valve 41A through the first outlet line OL1. A converter included in the first automatic outlet valve 41A controls the first automatic outlet valve 41A to selectively discharge the refrigerant introduced into the valve C to the valve A or the valve B. The converter included in the first automatic outlet valve 41A may be controlled by the system controller 1010.

A second outlet line OL2 may connect the second automatic outlet valve 41B to the second substrate processing device 100B. An inlet refrigerant passing through the second substrate processing device 100B may flow to the second automatic outlet valve 41B through the second outlet line OL2. Like the first automatic outlet valve 41A, the converter included in the second automatic outlet valve 41B controls the second automatic outlet valve 41B to selectively discharge the refrigerant introduced into the valve C to the valve A or the valve B. The converter included in the second automatic outlet valve 41B may be controlled by the system controller 1010.

The valve B of the first automatic outlet valve 41A and the valve B of the second automatic outlet valve 41B may be connected to the low-temperature tank 300 through a second low-temperature coolant line LL2. The valve A of the first automatic outlet valve 41A and the valve A of the second automatic outlet valve 41B may be connected to the high-temperature tank 200 through the second high-temperature coolant line HL2.

In an embodiment, the high-temperature coolant may be supplied from the high-temperature tank 200 to the first substrate processing device 100A and may reach the first automatic outlet valve 41A through the first substrate processing device 100A. Because the high-temperature coolant reaches the first automatic outlet valve 41A, the high-temperature coolant circulated in the substrate processing device is sent to the second high-temperature coolant line HL2 connected to the high-temperature tank 200. In contrast, the low-temperature coolant may be supplied from the low-temperature tank 300 to the second substrate processing device 100B and may reach the second automatic outlet valve 41B through the second substrate processing device 100B. Because the low-temperature coolant reaches the second automatic outlet valve 41B, the low-temperature coolant circulated in the substrate processing device is sent to the second low-temperature coolant line LL2 connected to the low-temperature tank 300.

That is, the first automatic outlet valve 41A and the second automatic outlet valve 41B may be controlled by the system controller 1010 so that the circulated high-temperature coolant returns to the high-temperature tank 200 and the circulated low-temperature coolant returns to the low-temperature tank 300. Through this, it is possible to recover the coolant with a small temperature difference so that it is possible to improve power consumption efficiency of the dual chiller system 1000A according to an embodiment.

Figure 6:
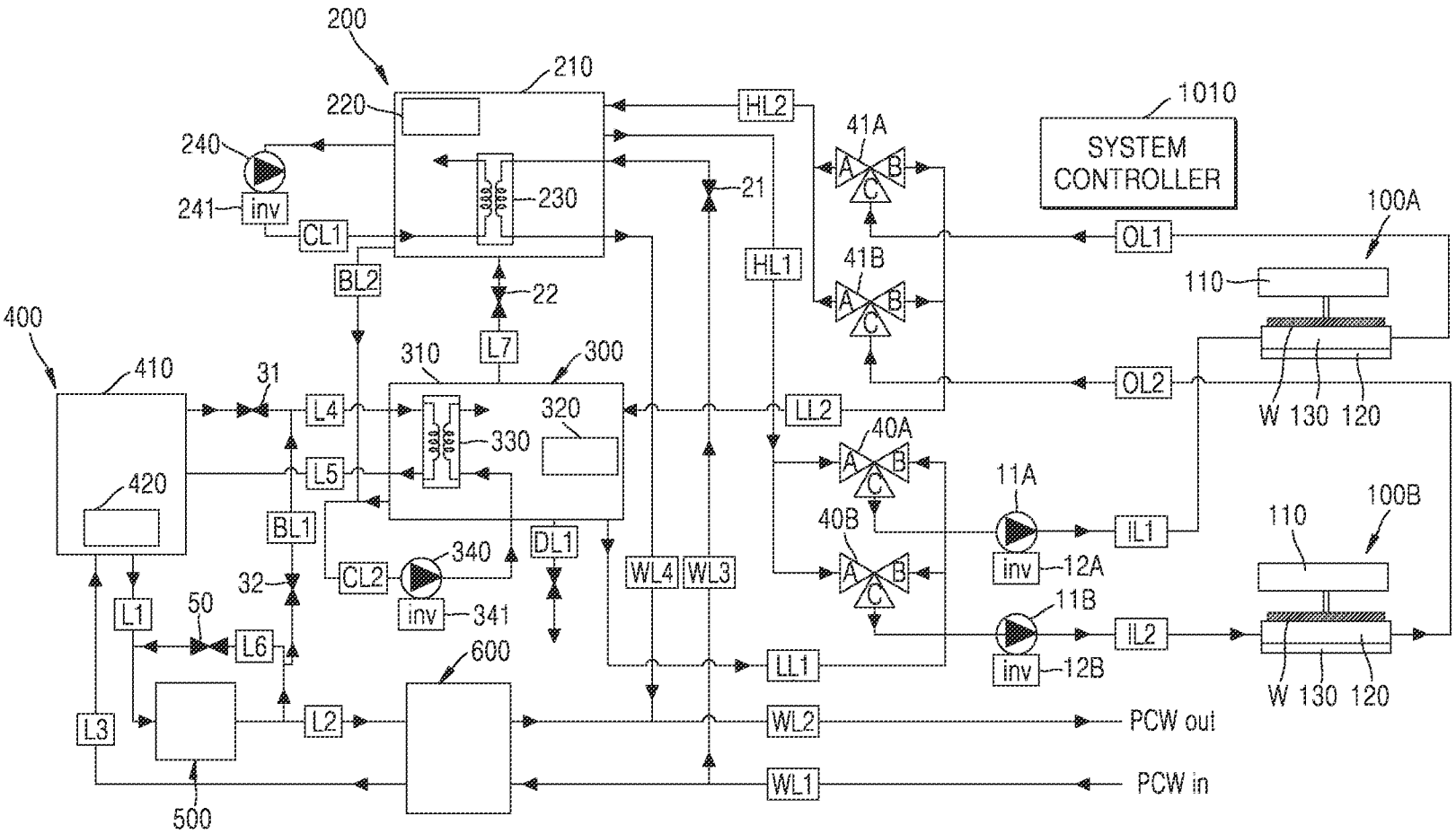
FIG. 6 is a diagram illustrating a dual chiller system according to an embodiment.

FIG. 6 is a diagram illustrating a dual chiller system 1000B according to an embodiment. Description previously given with reference to FIG. 1 is omitted.

Referring to FIG. 6, a sixth line L6 allowing a part of a high-temperature and high-pressure refrigerant from a compressor 500 to be mixed again into a first line L1 before being introduced into the compressor 500, a seventh line L7 connecting a high-temperature tank 200 to a low-temperature tank 300 to move a part of a low-temperature coolant, a second branch line BL2 connecting the high-temperature tank 200 to the low-temperature tank 300 to supply a part of a coolant from the high-temperature tank 200 to the low-temperature tank 300, a first circulation line CL1, a first circulation pump 240 on the first circulation line CL1, a second circulation line CL2, a second circulation pump 340 on the second circulation line CL2, and a drain line DLI connected to the low-temperature tank 300 may be further included.

The sixth line L6 may connect the second line L2 to the first line L1 so that the refrigerant discharged from the compressor 500 may be mixed again into the refrigerant of the first line L1 before being introduced into the compressor 500. A compressor circulation valve 50 may be provided on the sixth line L6. The compressor circulation valve 50 may be controlled by a system controller 1010 to control opening or closing of the compressor circulation valve 50. A first branch line BL1 mixing a part of the high-temperature refrigerant from the compressor 500 into a fourth line LA may be connected to the sixth line L6. The sixth line L6 may be referred to as a compressor circulation line in the current specification.

It is possible to prevent excessive pressurized refrigerant from being introduced into a condenser 600 through the sixth line L6 or from being introduced into the fourth line LA through the first branch line BL1. Accordingly, the stability of operation of the dual chiller system 1000B according to an embodiment may be improved through the sixth line L6.

The seventh line L7 may move the coolant from the low-temperature tank 300 to the high-temperature tank 200. A control valve 22 may be provided on the seventh line L7. The coolant may be circulated at high pressure in the low-temperature tank 300 through the seventh line L7. At least a part of an excessive pressure coolant may be moved to the high-temperature tank 200. The coolant moved from the low-temperature tank 300 to the high-temperature tank 200 may be circulated in the high-temperature tank 200 with the coolant circulated in the high-temperature tank 200.

When it is necessary to move a part of the coolant from the low-temperature tank 300 to the high-temperature tank 200, the system controller 1010 may control the control valve 22 to move the coolant from the low-temperature tank 300 to the high-temperature tank 200 through the seventh line L7.

That is, because the pressure of the coolant of the low-temperature tank 300 may be controlled by the seventh line L7 and the control valve 22, the stability of the dual chiller system 1000B according to an embodiment may be improved.

In the high-temperature tank 200, a coolant in a high-temperature tank body 210 may be introduced into a first heat exchanger 230 through the first circulation pump 240 provided on the first circulation line CL1. That is, the coolant may be more smoothly circulated in the high-temperature tank body 210 through the first circulation line CL1 and the first circulation pump 240 provided on the first circulation line CL1.

A first circulation pump inverter 241 controlling the first circulation pump 240 may be provided in the first circulation pump 240. The system controller 1010 may control a degree to which the first circulation pump 240 circulates the coolant through the first circulation pump inverter 241 according to the flow rate of PCW, the temperature of the PCW, the temperature of the high-temperature coolant, and the flow rate of the high-temperature coolant. Therefore, stable supply of the high-temperature coolant and heat exchange in the high-temperature tank 200 may be performed by the first circulation pump 240 and the first circulation pump inverter 241.

In the low-temperature tank 300, a coolant in a low-temperature tank body 310 may be introduced into a second heat exchanger 330 through the second circulation pump 340 provided on the second circulation line CL2. That is, the coolant may be more smoothly circulated in the low-temperature tank body 310 through the second circulation line CL2 and the second circulation pump 340 provided on the second circulation line CL2.

A second circulation pump inverter 341 controlling the second circulation pump 340 may be provided in the second circulation pump 340. The system controller 1010 may control a degree to which the second circulation pump 340 circulates the coolant through the second circulation pump inverter 341 according to the temperature of a refrigerant, the flow rate of a refrigerant, the temperature of the low-temperature coolant, and the flow rate of the low-temperature coolant. Therefore, stable supply of the low-temperature coolant and heat exchange in the low-temperature tank 300 may be performed by the second circulation pump 340 and the second circulation pump inverter 341.

The second branch line BL2 may connect the high-temperature tank 200 to the second circulation line CL2 so that the coolant of the high-temperature tank 200 is mixed into the second circulation line CL2. The second branch line BL2 may move a part of the coolant of the high-temperature tank 200 to the low-temperature tank 300 when the coolant is insufficient in the low-temperature tank 300. The high-temperature tank body 210 may include a separate coolant supply port. Accordingly, stable coolant circulation in the low-temperature tank 300 may be performed through the second branch line BL2.

The drain line DLI may discharge the coolant from the low-temperature tank 300 to the outside so that the coolant may be discharged from the low-temperature tank 300 to control an increase in pressure due to vaporization or oversupply of the low-temperature coolant in the low-temperature tank 300.

In summary, the dual chiller system 1000B according to an embodiment may effectively supply the coolant to the substrate processing device and may reduce power consumption to improve system operation efficiency. In addition, the stability of a cooling unit including a cascade 400, the compressor 500, and the condenser 600, the high-temperature tank 200, and the low-temperature tank 300 is increased to improve the stability of the dual chiller system 1000B.

In the dual chiller systems 1000A and 1000B described herein, the refrigerant and the coolant are separately named. The refrigerant circulates through the low-temperature tank 300, the cascade 400, the compressor 500, and the condenser 600. The coolant circulates from the high-temperature tank 200 and the low-temperature tank 300 to the first substrate processing device 100A and the second substrate processing device 100B.

In an embodiment, a refrigerant may be properly selected from R-134a, R-410A, R-22, R-404A, and R-407C according to an operating temperature and purpose. The coolant may be properly selected from ethylene glycol, propylene glycol, and glycerin according to an operating temperature and purpose. Types of a refrigerant and a coolant used in a dual chiller system are not limited by the current specification.

A dual chiller system 1000C according to an embodiment may include two or more substrate processing devices. That is, N (N is a natural number equal to or greater than 2) substrate processing devices may be provided. An automatic inlet valve and an automatic outlet valve may be provided in each substrate processing device. The high-temperature coolant of the high-temperature tank 200 and the low-temperature coolant of the low-temperature tank 300 may be supplied to all automatic inlet valves.

Because the dual chiller systems 1000A and 1000B according to an embodiment are two substrate processing devices, the output level of the compressor 500 when the coolant circulates through the substrate processing devices is divided into a first output level, a second output level, and a third output level. In contrast, because the dual chiller system 1000C according to an embodiment includes N substrate processing devices, a low-temperature coolant may be supplied to N to 0 substrate processing devices among the N substrate processing devices. Accordingly, the output level of a compressor 500 may be divided into (N+1) outputs and operated.

For example, when one substrate processing device is provided, the output level of the compressor 500 when the low-temperature coolant is supplied to the substrate processing device may be operated differently from the output level of the compressor 500 when the low-temperature coolant is not supplied to the substrate processing device.

Accordingly, the output level of the compressor 500 may be divided into two types of outputs.

For example, when three substrate processing devices are provided, the output level of the compressor 500 may be divided into a first output level for supplying the low-temperature coolant to all the three substrate processing devices, a second output level for supplying the low-temperature coolant to two substrate processing devices, a third output level for supplying the low-temperature coolant to one substrate processing device, and a fourth output level when the low-temperature coolant is not supplied to the substrate processing devices. That is, the output level of the compressor 500 may be controlled to be divided into the first to fourth output levels for the three substrate processing devices. In addition, in a standby state in which the coolant is not supplied to the three substrate processing devices, the output level of the compressor 500 may be controlled as a fifth output level. The fifth output level may be less than the first to third output levels described above.

The system controller 1010 may control the N automatic inlet valves so that the high-temperature coolant is supplied to P (P is a natural number equal to or less than N or 0) substrate processing devices among the N substrate processing devices, and the output level of the compressor 500 is operated as a (P+1)th output.

For example, when the high-temperature coolant is to be supplied to zero substrate processing devices among the three substrate processing devices, in other words, the low-temperature coolant must be supplied to all the three substrate processing devices. In this case, because a high output level of the compressor 500 is required, the output level of the compressor 500 may be controlled by the system controller 1010 as the first output level.

When the high-temperature coolant is to be supplied to all the three substrate processing devices, in other words, the low-temperature coolant is not supplied to all the three substrate processing devices. In this case, because a low output level of the compressor 500 is required, the output level of the compressor 500 may be controlled by the system controller 1010 as the fourth output level.

When the three substrate processing devices are provided and the high-temperature coolant is supplied to zero or three substrate processing devices, three automatic inlet valves connected to the three substrate processing devices are controlled by the system controller 1010 so that the high-temperature coolant or the low-temperature coolant is introduced.

According to the temperature of the coolant required by the substrate processing device, the automatic valve may selectively supply the high-temperature coolant or the low-temperature coolant to the substrate processing device as described above. That is, the system controller 1010 controls the output level of the compressor 500 according to the flow rate of the low-temperature coolant to optimize power consumed by the compressor 500 in the dual chiller system 1000C and thus to improve the efficiency of the dual chiller system 1000C.

While the disclosure has been particularly shown and described with reference to embodiments thereof, it will be understood that various changes in form and details may be made therein without departing from the spirit and scope of the following claims.

What is claimed is:

1. A dual chiller system comprising:

a high-temperature tank comprising a first heater and a first heat exchanger, the high-temperature tank configured to supply a first coolant of a first temperature;

a low-temperature tank comprising a second heater and a second heat exchanger, the low-temperature tank configured to supply a second coolant of a second temperature lower than the first temperature;

a first automatic inlet valve and a second automatic inlet valve respectively connected to the high-temperature tank and the low-temperature tank and configured to select and supply the first coolant supplied from the high-temperature tank or the second coolant supplied from the low-temperature tank;

a first substrate processing device configured to receive the first coolant or the second coolant from the first automatic inlet valve and a second substrate processing device configured to receive the first coolant or the second coolant from the second automatic inlet valve, the first substrate processing device and the second substrate processing device each comprising a heater and a substrate support;

a cooling unit comprising a cascade heat-exchange unit, a compressor, a condenser, a first branch line configured to introduce a refrigerant from the compressor into a line supplying the refrigerant from the cascade heat-exchange unit to the low-temperature tank, a control valve provided on the first branch line, and the refrigerant circulating through the cascade heat-exchange unit, the compressor, and the condenser; and a system controller configured to:

control an output level of the compressor, and control the first automatic inlet valve and the second automatic inlet valve to selectively supply the first coolant or the second coolant to the first substrate processing device and the second substrate processing device, wherein the output level of the compressor comprises a first output level, a second output level, and a third output level, wherein the first output level is greater than the second output level, and the second output level is greater than the third output level, wherein the compressor is configured such that the refrigerant is introduced into the compressor from the cascade heat-exchange unit, wherein the refrigerant condensed by the condenser is introduced into the cascade heat-exchange unit, wherein the refrigerant discharged from the low-temperature tank is introduced into the cascade heat-exchange unit, and wherein the cascade heat-exchange unit is configured to receive the refrigerant introduced from the condenser as an input and to supply the refrigerant to the low-temperature tank through heat exchange.

2. The dual chiller system of claim 1, wherein the system controller is further configured to:

control the first automatic inlet valve and the second automatic inlet valve to supply the first coolant to the first substrate processing device and the second substrate processing device when the output level is the third output level, control the first automatic inlet valve and the second automatic inlet valve to supply the first coolant to the first substrate processing device and to supply the second coolant to the second substrate processing device when the output level is the second output level, and control the first automatic inlet valve and the second automatic inlet valve to supply the second coolant to the first substrate processing device and the second substrate processing device when the output level is the first output level.

3. The dual chiller system of claim 2, wherein the high-temperature tank further comprises a first circulation line and a first circulation pump provided on the first circulation line, wherein the low-temperature tank further comprises a second circulation line and a second circulation pump provided on the second circulation line, wherein the first circulation line is connected to the first heat exchanger and the second circulation line is connected to the second heat exchanger, and wherein the first circulation pump is configured to circulate the first coolant through the first circulation line so that heat is exchanged in the first heat exchanger, and the second circulation pump is configured to circulate the second coolant through the second circulation line so that heat is exchanged in the second heat exchanger.

4. The dual chiller system of claim 3, wherein the cooling unit further comprises:

a compressor circulation line connected to a line connecting the compressor and the condenser and also connected to a line connecting the cascade heat-exchange unit to the compressor; and a compressor circulation valve provided on the compressor circulation line, and wherein the first branch line is configured to receive the refrigerant from the compressor circulation line.

5. The dual chiller system of claim 1, further comprising a receiver in the cascade heat-exchange unit.

6. The dual chiller system of claim 3, further comprising:

a connection line configured to move the second coolant from the low-temperature tank to the high-temperature tank; and a control valve provided on the connection line.

7. The dual chiller system of claim 3, further comprising a second branch line connecting the high-temperature tank to the second circulation line and configured to supply the first coolant to the second circulation line from the high-temperature tank.

8. The dual chiller system of claim 1, wherein each of the first substrate processing device and the second substrate processing device are configured to perform an electrical die sorting process.

9. The dual chiller system of claim 1, further comprising:

a first automatic outlet valve connected to the first substrate processing device by a first outlet line; and a second automatic outlet valve connected to the second substrate processing device by a second outlet line, wherein the first automatic outlet valve and the second automatic outlet valve are connected to the high-temperature tank and the low-temperature tank, respectively.

10. The dual chiller system of claim 9, wherein the system controller is further configured to control the first automatic outlet valve and the second automatic outlet valve to supply either the first coolant or the second coolant to the first substrate processing device and the second substrate processing device, wherein, based on the first coolant being supplied to either the first substrate processing device or the second substrate processing device, the supplied first coolant is recovered to the high-temperature tank, and wherein, based on the second coolant being supplied to either the first substrate processing device or the second substrate processing device, the supplied second coolant is recovered to the low-temperature tank.

11. The dual chiller system of claim 2, wherein the first output level is in a range from 80% to 100% of a maximum output of the compressor, the second output level is in a range of 60% to 80% of the maximum output of the compressor, and the third output level is less than 60% of the maximum output of the compressor.

12. The dual chiller system of claim 2, wherein the output level of the compressor further comprises a fourth output level that is less than the first output level and the second output level, and wherein the system controller is further configured to:

control the first automatic inlet valve and the second automatic inlet valve not to supply the first coolant and the second coolant to the first substrate processing device and the second substrate processing device when the output level is the fourth output level.

13. The dual chiller system of claim 1, wherein the first temperature is 20° C. or more and 80° C. or less, and wherein the second temperature is −80° C. or more and −50° C. or less.

14. A dual chiller system comprising:

a high-temperature tank comprising a first heater and a first heat exchanger, the high-temperature tank configured to supply a first coolant of a first temperature;

a low-temperature tank comprising a second heater and a second heat exchanger, the low-temperature tank configured to supply a second coolant of a second temperature lower than the first temperature;

a plurality of automatic inlet valves respectively connected to the high-temperature tank and the low-temperature tank and configured to select and supply the first coolant supplied from the high-temperature tank or the second coolant supplied from the low-temperature tank;

a plurality of substrate processing devices configured to receive the first coolant or the second coolant from the plurality of automatic inlet valves, wherein a number of substrate processing devices included in the plurality of substrate processing devices is equal to a number of automatic inlet valves included in the plurality of automatic inlet valves, and each of the plurality of substrate processing devices comprises a heater and a substrate support;

a cooling unit comprising a cascade heat-exchange unit, a compressor, a condenser, a first branch line configured to introduce a refrigerant from the compressor into a line supplying the refrigerant from the cascade heat-exchange unit to the low-temperature tank, and a control valve provided on the first branch line; and a system controller configured to:

control an output level of the compressor, and control the plurality of automatic inlet valves to selectively supply the first coolant or the second coolant to each of the plurality of substrate processing devices, wherein the output level of the compressor comprises a plurality of output levels, wherein a number of output levels included in the plurality of output levels is one greater than the number of substrate processing devices included in the plurality of substrate processing devices, wherein M is a natural number less than the number of substrate processing devices included in the plurality of substrate processing devices, and an Mth output level is greater than an (M+1)th output, wherein the compressor is configured such that the refrigerant is introduced into the compressor from the cascade heat-exchange unit, wherein the refrigerant condensed by the condenser is introduced into the cascade heat-exchange unit, wherein the refrigerant discharged from the low-temperature tank is introduced into the cascade heat-exchange unit, and wherein the cascade heat-exchange unit is configured to receive the refrigerant introduced from the condenser as an input and to supply the refrigerant to the low-temperature tank through heat exchange.

15. The dual chiller system of claim 14, wherein the system controller is further configured to:

control the plurality of automatic inlet valves to supply the first coolant to P substrate processing devices among the plurality of substrate processing devices when the output level of the compressor is a (P+1)th output, wherein P is either 0 or a natural number equal to or less than the number of substrate processing devices included in the plurality of substrate processing devices.

16. The dual chiller system of claim 14, wherein the plurality of substrate processing devices consists of three substrate processing devices, and the plurality of automatic inlet valves consists of three automatic inlet valves.

17. The dual chiller system of claim 14, wherein the high-temperature tank further comprises a first circulation line and a first circulation pump provided on the first circulation line, wherein the low-temperature tank further comprises a second circulation line and a second circulation pump provided on the second circulation line, wherein the first circulation line is connected to the first heat exchanger and the second circulation line is connected to the second heat exchanger, and wherein the first circulation pump is configured to circulate the first coolant through the first circulation line so that heat is exchanged in the first heat exchanger, and the second circulation pump is configured to circulate the second coolant through the second circulation line so that heat is exchanged in the second heat exchanger.

18. The dual chiller system of claim 17, further comprising:

a connection line configured to move the second coolant from the low-temperature tank to the high-temperature tank;

a control valve provided on the connection line; and a second branch line connecting the high-temperature tank to the second circulation line and configured to supply the first coolant to the second circulation line from the high-temperature tank.

19. A dual chiller system comprising:

a high-temperature tank comprising a first heater, a first heat exchanger, a first circulation line, and a first circulation pump provided on the first circulation line, wherein the high-temperature tank is configured to supply a first coolant of a first temperature;

a low-temperature tank comprising a second heater, a second heat exchanger, a second circulation line, and a second circulation pump provided on the second circulation line, wherein the low-temperature tank is configured to supply a second coolant of a second temperature lower than the first temperature;

a first automatic inlet valve and a second automatic inlet valve respectively connected to the high-temperature tank and the low-temperature tank and configured to select and supply the first coolant supplied from the high-temperature tank or the second coolant supplied from the low-temperature tank;

a first substrate processing device configured to receive the first coolant or the second coolant from the first automatic inlet valve and a second substrate processing device configured to receive the first coolant or the second coolant from the second automatic inlet valve, the first substrate processing device and the second substrate processing device each comprising a heater and a substrate support;

a first automatic outlet valve connected to the first substrate processing device by a first outlet line;

a second automatic outlet valve connected to the second substrate processing device by a second outlet line;

a cooling unit comprising a cascade, a compressor, a condenser, a first branch line configured to introduce a refrigerant from the compressor into a line supplying the refrigerant from the cascade to the low-temperature tank, a control valve provided on the first branch line, and the refrigerant circulating through the cascade, the compressor, and the condenser, wherein the cascade comprises a receiver; and a system controller, wherein the first circulation line is connected to the first heat exchanger and the second circulation line is connected to the second heat exchanger, wherein an output level of the compressor comprises a first output level, a second output level, and a third output level, wherein the first output level is greater than the second output level, and the second output level is greater than the third output level, and wherein the system controller is configured to:

control the output level to be the third output level and control the first automatic inlet valve and the second automatic inlet valve to supply the first coolant to the first substrate processing device and the second substrate processing device when the output level is the third output level, control the output level to be the second output level and control the first automatic inlet valve and the second automatic inlet valve to supply the first coolant to the first substrate processing device and to supply the second coolant to the second substrate processing device when the output level is the second output level, and control the output level to be the first output level and control the first automatic inlet valve and the second automatic inlet valve to supply the second coolant to the first substrate processing device and the second substrate processing device when the output level is the first output level.

20. The dual chiller system of claim 19, further comprising:

a connection line configured to move the second coolant from the low-temperature tank to the high-temperature tank;

a control valve provided on the connection line; and a second branch line connecting the high-temperature tank to the second circulation line and configured to supply the first coolant to the second circulation line from the high-temperature tank, wherein the cooling unit further comprises:

a compressor circulation line connected to a line connecting the compressor and the condenser and also connected to a line connecting the cascade to the compressor; and a compressor circulation valve provided on the compressor circulation line, wherein each of the first substrate processing device and the second substrate processing device are configured to perform an electrical die sorting process, wherein the output level of the compressor further comprises a fourth output level that is less than the first output level and the second output level, wherein the first output level is in a range of 80% to 100% of a maximum output of the compressor, the second output level is in a range of 60% to 80% of the maximum output of the compressor, and the third output level is less than 60% of the maximum output of the compressor, wherein the system controller is further configured to:

control the output level to be the fourth output level and control the first automatic inlet valve and the second automatic inlet valve not to supply the first coolant and the second coolant to the first substrate processing device and the second substrate processing device when the output level is the fourth output level, and wherein the first temperature is 20° C. or more and 80° C. or less, and the second temperature is −80° C. or more and −50° C. or less.

* * * * *